US008118972B2

(12) United States Patent
Eichhorn et al.

(10) Patent No.: US 8,118,972 B2
(45) Date of Patent: Feb. 21, 2012

(54) LOTIONED TISSUE PAPER HAVING A SHORT WATER ABSORPTION TIME

(75) Inventors: Stephan Eichhorn, Gernsheim (DE); Rolf Kawa, Monheim (DE); Jorg Sorns, Dusseldorf (DE); Andrea Urban, Ludwigshafen (DE)

(73) Assignee: SCA Hygiene Products GmbH, Mannheim (DE)

( * ) Notice: Subject to any disclaimer, the term of this patent is extended or adjusted under 35 U.S.C. 154(b) by 296 days.

(21) Appl. No.: 12/127,456

(22) Filed: May 27, 2008

(65) Prior Publication Data

US 2008/0223535 A1 Sep. 18, 2008

Related U.S. Application Data

(63) Continuation of application No. PCT/EP2005/012639, filed on Nov. 25, 2005.

(51) Int. Cl.
*D21H 21/22* (2006.01)
*A61Q 19/00* (2006.01)
*C11D 17/04* (2006.01)

(52) U.S. Cl. ..... 162/135; 162/123; 162/158; 162/164.1; 424/402; 428/172; 428/195.1

(58) Field of Classification Search ..... 162/109, 162/123–129, 135, 158, 164.1, 168.1, 172–173, 162/179; 424/400–404; 428/172, 195.1, 428/375, 480
See application file for complete search history.

(56) References Cited

U.S. PATENT DOCUMENTS

| | | | | |
|---|---|---|---|---|
| 5,935,384 | A | 8/1999 | Taniguchi et al. | |
| 6,491,933 | B2 * | 12/2002 | Lorenzi et al. | 424/401 |
| 6,860,967 | B2 * | 3/2005 | Baumoller et al. | 162/158 |
| 6,905,697 | B2 * | 6/2005 | Baumoller et al. | 424/402 |
| 7,285,283 | B2 * | 10/2007 | Baumoeller et al. | 424/400 |
| 7,365,030 | B2 * | 4/2008 | Chamba et al. | 442/123 |
| 7,452,917 | B2 * | 11/2008 | Baumoeller et al. | 516/73 |
| 7,622,021 | B1 * | 11/2009 | Baumoeller et al. | 162/158 |
| 7,666,827 | B2 * | 2/2010 | Marsh et al. | 510/439 |
| 2002/0146561 | A1 * | 10/2002 | Baumoller et al. | 428/375 |
| 2005/0008680 | A1 * | 1/2005 | Deckner et al. | 424/443 |
| 2005/0008681 | A1 * | 1/2005 | Deckner et al. | 424/443 |
| 2005/0031568 | A1 * | 2/2005 | Deckner | 424/70.17 |
| 2005/0100573 | A1 * | 5/2005 | Baumoller et al. | 424/402 |

(Continued)

FOREIGN PATENT DOCUMENTS

EP 279641 A2 * 8/1988

(Continued)

*Primary Examiner* — Jose A Fortuna
(74) *Attorney, Agent, or Firm* — Young & Thompson

(57) ABSTRACT

Toilet paper based on tissue paper being treated with an O/W emulsion comprising at least one non-ionic emulsifier, at least one anionic co-emulsifier, an oil component having a polarity of at least 20 mN/m or a mixture of oil components wherein at least 75 weight-% of the oils constituting the mixture have a polarity of at least 20 mN/m, 6 to 35 weight % of water, based on the total weight of the emulsion, wherein the total amount of emulsifiers and co-emulsifiers is between 4 and 20 weight based on the total weight of the emulsion. Since in the above lotion composition the external phase is aqueous, a web treated therewith can easily be wet by water and does not float on the water if it is to be disposed in a toilet. Moreover, this lotion shows an improved brightness after application on tissue paper, smell and rheology.

33 Claims, 1 Drawing Sheet

Viscosity of the lotion of the Example in dependance of the temperature

U.S. PATENT DOCUMENTS

| | | | | |
|---|---|---|---|---|
| 2008/0223535 | A1 * | 9/2008 | Eichhorn et al. | 162/123 |
| 2009/0082284 | A1 * | 3/2009 | Sorns et al. | 514/23 |
| 2009/0314444 | A1 * | 12/2009 | Sorns et al. | 162/135 |

FOREIGN PATENT DOCUMENTS

| | | | |
|---|---|---|---|
| EP | 1029977 | | 8/2000 |
| EP | 1225276 | A1 * | 7/2002 |
| EP | 1225277 | A1 * | 7/2002 |
| EP | 1813311 | A1 * | 8/2007 |
| FR | 2538238 | | 6/1984 |
| WO | 9405856 | | 3/1994 |
| WO | 9516824 | | 6/1995 |
| WO | 9624723 | | 8/1996 |
| WO | 9824871 | | 6/1998 |
| WO | 02057547 | | 7/2002 |
| WO | WO 2007059789 | A1 * | 5/2007 |
| WO | WO 2007059888 | A2 * | 5/2007 |

* cited by examiner

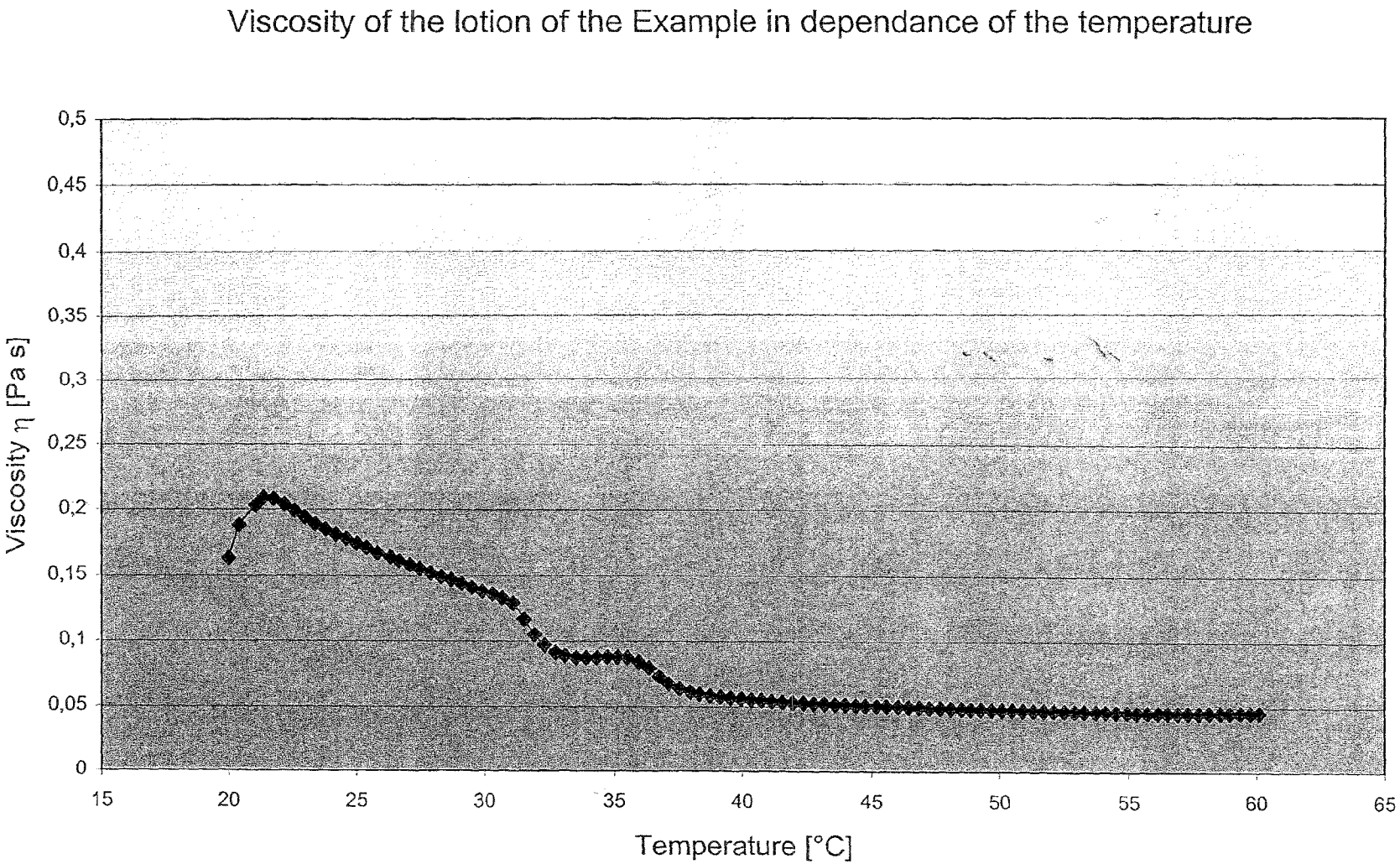
Viscosity of the lotion of the Example in dependance of the temperature
Viscosity η [Pa s]
0,5
0,45
0,4
0,35
0,3
0,25
0,2
0,15
0,1
0,05
0
15
20
25
30
35
40
45
50
55
60
65
Temperature [°C]

LOTIONED TISSUE PAPER HAVING A SHORT WATER ABSORPTION TIME

CROSS REFERENCE TO RELATED APPLICATIONS

This is a continuation of international application PCT/EP2005/012639 filed 25 Nov. 2005, which designated the United States of America.

FIELD OF INVENTION

The invention relates to a soft lotioned tissue paper web, which easily sinks in water due to a specific lotion based on an oil-in-water emulsion.

BACKGROUND ART

Based on the underlying compatibility of the production processes (wet laying), "tissue" production is counted among the paper making techniques. The production of tissue is distinguished from paper production by its extremely low basis weight of normally less than 65 g/m2 and its much higher tensile energy absorption index. The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). In the latter technique, often referred to as "(wet) rush transfer", for instance the forming fabric of the paper machine is moved at greater speed than that of the fabric to which the formed paper web is transferred, for instance a transfer fabric or a TAD fabric (through air drying), so that the paper web is somewhat bundled when it is taken up by the transfer fabric. Many prior art documents (e.g. EP-A-0 617 164, WO-94/28244, U.S. Pat. No. 5,607,551, EP-A-0 677 612, WO-96/09435) refer to this as "inner creping", when they describe the production of "uncreped" tissue paper by rush transfer techniques. The inner and outer creping causes the still moist, plastically deformable paper web to be internally broken up by compression and shearing, thereby rendering it more stretchable under load than uncreped paper. Most of the functional properties typical of tissue and tissue products result from a high tensile energy absorption index (see DIN EN 12625-4 and DIN EN 12625-5).

Typical properties of tissue paper include the ready ability to absorb tensile stress energy, their drapability, good textile-like flexibility, a high specific volume with a perceptible thickness, as high a liquid absorbency as possible and, depending on the application, a suitable wet and dry strength as well as an interesting visual appearance of the outer product surface.

Softness is an important property of tissue products such as handkerchiefs, cosmetic wipes, toilet paper, serviettes/napkins, not to mention hand or kitchen towels, and it describes a characteristic tactile sensation caused by the tissue product upon contact with the skin.

Although the term "softness" is generally comprehensible, it is extremely difficult to define because there is no physical method of determination and, consequently no recognized industrial standard for the classification of different degrees of softness.

To be able to detect softness at least semi-quantitatively, softness is determined In practice by means of a subjective method. To do so, use is made of a "panel test" in which several trained test persons give a comparative opinion.

In simplified terms, softness can be subdivided into its main characteristics, surface softness and bulk softness.

Surface softness describes the feeling perceived when e.g. one's fingertips move lightly over the surface of the sheet of tissue. Bulk softness is defined as the sensory impression of the resistance to mechanical deformation that is produced by a tissue or tissue product manually deformed by crumpling or folding and/or by compression during the process of deformation.

One method for increasing bulk softness of tissue paper as taught by WO 96/25557 involves a) wet-laying an aqueous slurry containing cellulosic fibres to form a web b) applying a water soluble polyhydroxy compound to the wet web, and c) drying and creping the web (wet web addition method).

It is further known from U.S. Pat. No. 4,764,418 that some humectants such as polyethylene glycol contribute to the softness of tissue products if they are applied to a dry web.

The use of humectants, such as polyhydroxy compounds, in highly concentrated form, as softeners however, has the disadvantage that the humectant may, upon contact, draw too much moisture from the skin, for instance when blowing one's nose with a tissue handkerchief. Moreover the softening effect is not yet satisfactory.

WO 96/24723 teaches increasing the surface softness of tissue paper by applying discrete deposits of a water free lotion composition containing an oil and a wax. Since however, due to its solid consistency, the treatment composition remains on the surface of the tissue paper, it cannot contribute to bulk softness. Further, water-free lotion compositions based on waxy or oily materials often feel unpleasantly greasy or oily.

Moreover, water-free lotions such as the one in WO 96/24723 often do not feel particularly pleasant to the skin.

EP A 1 029 977 relates to a composition for treating paper products, such as tissue products, comprising between 30 and 90% by weight of oil, between 1 and 40% by weight of wax, between 1 and 30% by weight of an emulsifying agent and between 5 and 35% by weight of water. These lotion compositions are based on W/O emulsions, are solid or semisolid at 30° C., and remain primarily at the surface of the tissue paper, although they penetrate the tissue paper somewhat more than the solid composition of WO 96/24723.

DE 199 06 081 A1 discloses emulsions containing (a) 5 to 25% by weight polyol poly-12-hydroxy stearate, (b) 50 to 90% by weight waxy esters, and (c) 5 to 25% by weight waxes. This document further contains examples describing the treatment of tissue papers with W/O emulsions as defined above containing about 20 to 25% water. These compositions are solid or semisolid at 30° C. (Example 1 corresponds to lotion F of EP A 1 029 977) and demonstrate the same penetration behavior as described above for the lotions of EP A 1 029 977.

However, tissue papers treated with water-in-oil (W/O) lotions often float on the water for a longer time and cannot be flushed down, if they are to be disposed in a toilet. This is a serious disadvantage, in particular for lotioned toilet papers which are becoming increasingly popular due to their softness and pleasant feel on the skin of the user.

WO 97/30216 discloses a softening lotion composition for treating tissue. The composition is aqueous and liquid, and includes as active ingredients (a) one or more saturated straight fatty alcohols having at least 16 C atoms in a preferred amount of 35 to 90% by weight,
(b) one or more waxy esters having a total of at least 24 C atoms in a preferred amount of 1 to 50% by weight,
(c) optionally non-ionic and/or amphoteric emulsifiers, preferably oil-in-water emulsifiers, and
(d) optionally 0 to 50% mineral oil.

The lotion composition comprises 1 to 50% by weight active ingredients and consequently 50 to 99% by weight of water. According to the teaching of WO 97/30217, this aqueous composition is combined with a quaternary ammonium compound.

If such high water content lotions are applied to tissue paper, they can strongly affect the strength properties (dry strength or wet strength, if additional water, e.g. from body fluids is absorbed by the tissue paper).

WO 02/057547 A2 relates to a lotioned fibrous web, in particular tissue paper web having a short water absorption time. This web is treated with a lotion composition based on an O/W emulsion comprising A) at least one oil
B) an (O/W) emulsifier or (O/W) emulsifier combination, and
C) 6 to 35 wt.-% of water, based on the total weight of the lotion composition.

The oil component may be selected from glycerides, natural plant oils, dialk(en)yl ethers, dialk(en)yl carbonates, hydrocarbon-based oils, waxy esters and silicon oils. The specific combination of hydrocarbon-based oils, such as mineral oil and fatty ester emollients is not disclosed. On a concrete level, this international application also pertains to a lotioned tissue paper wherein the lotion comprises as main components 5.3 wt.-% polyglyceryl poly(12-hydroxystearate) (Dehymuls® PGPH), 5.3 wt.-% lauryl glucosid, 3.0 wt.-% glyceryl stearate, 30.0 wt.-% cocoglyceride, 30.0 wt.-% di-N-octylcarbonate, 1.5 wt.-% bisabolol and 4.0 wt.-% glycerol. This lotion is also disclosed as "composition 1" in WO 02/056841.

Although this lotion shows a good stability under usual conditions, stability problems may occur if it is stored for very long times or at higher temperatures. Moreover, it was noted that specifically the incorporation of plant extracts may cause an undesired coloring which lowers the whiteness (brightness) of tissue paper treated therewith. In addition, some customers perceived an undesired smell if this lotion was stored over a longer period of time.

In view of the above, one object of the present invention involves providing a lotion-treated toilet paper that overcomes the disadvantages of prior art formulations.

In a first aspect, the present invention is intended to provide a lotioned toilet paper which can be easily disposed of in a toilet, since it does not float on the water for long.

In a further aspect, the present invention seeks to provide a lotioned toilet paper, the strength properties of which are not greatly deteriorated by the application of lotion.

A further technical object of the present invention is to provide a lotioned toilet paper web which feels very pleasant to the skin and is not oily or greasy to the touch.

Moreover, the present invention also aims at providing a lotioned toilet paper web which shows an enhanced degree of whiteness (brightness).

It is one further technical object of the present Invention to provide a toilet paper treated with a lotion composition that can be applied at relatively low temperatures.

Finally, it is one further technical object of the present invention to provide a toilet paper treated with a lotion composition wherein said lotion composition shows a suitable, in particular improved balance of critical properties including stability, softness and/or sensory impression, compatibility with plant extracts and application temperature.

Further technical objects may become apparent to a skilled person when studying the following description.

SUMMARY OF THE INVENTION

This technical object is solved by a toilet paper based on tissue paper, said tissue paper being treated with an O/W emulsion comprising:

at least one non-ionic emulsifier, at least one anionic co-emulsifier, one oil component having a surface tension of at least 20 mN/m or a mixture of oil components wherein at least 75 weight-% of the oils constituting the mixture have a surface tension of at least 20 mN/m, 6 to 35 weight-% of water, based on the total weight of the emulsion, wherein the total amount of emulsifiers and co-emulsifiers is between 4 and 20 weight-%, preferably between 6 and 16 weight-%, based on the total weight of the emulsion.

This emulsion gives a lotion-like feel to the user of the toilet paper and is at least partially transferable. Further, if desired, the toilet paper is capable of transferring active agents to the skin of the user. For this reason the terms "emulsion" and "lotion" will be used throughout the present specification as synonyma. Since in the above emulsion/lotion composition the external phase is aqueous, a web treated therewith can be easily wet by water and therefore shows an excellent sinking behavior in water. The water absorption time (measured according to DIN V ENV 12625-8 of May 2001 "Water absorption time, water absorption capacity—manual and automated test method", identical with the corresponding prestandard explained in WO 02/057547) is preferably is less than 1 min, more preferably less than 30 sec, in particular less than 10 sec.

Moreover, the lotion/emulsion also contributes to the bulk softness of the toilet paper since it preferably migrates into the tissue paper.

BRIEF DESCRIPTION OF THE DRAWING

FIG. 1 shows a rheology profile of the lotion according to the Example wherein the viscosity was determined in relation to the temperature of the measurement.

DETAILED DESCRIPTION OF THE INVENTION

The lotioned toilet paper of the invention is typically obtained by applying the aforementioned lotion composition to a dry tissue web (without lotion). Preferably, the residual water content of the tissue web is no more than 10% by weight.

Unless stated otherwise, the terms "liquid" and "solid" refer to the physical state at 23° C. Moreover, it should be noted that the use of "comprising" is intended to cover the more limiting expressions "consisting essentially of" and "consisting of".

1. Lotion

By mixing and homogenizing at least one oil (mixture), a non-ionic (O/W) emulsifier or non-ionic (O/W) emulsifier combination, an anionic co-emulsifier and water, a stable oil-in-water (O/W) emulsion is obtained.

The lotion composition can be a semi-solid or a viscous liquid at room temperature (23° C.), the latter being preferred.

In the first case, it typically has a viscosity of less than 30,000 mPa·s at 25° C. (measured with a Brookfield-RVF viscosimeter, spindle 3, 10 rpm). Then, the lotion composition primarily remains on the surface of the fibrous substrate, contributing to surface softness of the product, and to a lesser extent to bulk softness.

In a preferred embodiment, the lotion has a fairly low viscosity in comparison to known semi-solid lotion compositions for tissues. This low viscosity contributes to an excellent penetration behavior and prevents it from remaining on the surface of a single or multi-ply tissue product. In the case of single-ply tissues, it fully penetrates and softens the ply. In the case of multi-ply tissue products, the lotion composition reaches the inner plies, thereby greatly enhancing bulk softness. Such a low viscosity lotion preferably has a viscosity of 100 to 10,000 mPa·s, preferably 500 to 3,000 mPa·s at 25° C. (measured with a Brookfield-RVF viscosimeter, spindle 3, 10 rpm).

If measured by a rheometer, the lotion used in the present invention shows a viscosity [mPa·s] of less than 1, preferably less than 0.8, in particular less than 0.5 (e.g. 0.01 to 0.3) in the temperature range of 20 to 60° C. (shear rate D=50 1/sec, CR mode (rotation), constant heating from 20 to 60° C. over 450 sec, number of measuring points 200), as shown in FIG. 1. The measurement was conducted with a Haake RheoStress RS1 rheometer (now available from Thermo Electron) under the following additional conditions regarding measurement geometry: sensor C35/2° Ti, A-factor of 89090.000 Pa/Nm, M-factor of 28.650 (1/s)/(rad/s), moment of inertia: 1.769e-06 kg m2, attenuation of 30.00 and slit width 0.105 mm. The tempering device used was TCP/P (Peltier/Plate).

The viscosity of the lotion can be adjusted, as known in the art, by the use of higher or lower amounts of solid components, in particular the consistency regulators mentioned below. Further the homogenization of the lotion (energy influx) may have an impact on the final viscosity. The melting range of the optionally present solid components, as measured according to DSC analysis of the final lotion composition, preferably lies within the temperature range of 25° to 70° C., in particular 30° to 60° C.

This lotion/emulsion does not require the presence of silicone containing compounds, e.g. silicone oils or quaternary amine compounds in order to attain its softening effect, although their use is not excluded.

According to one embodiment the lotion/emulsion has the following composition:

a) at least one non-ionic emulsifier having an HLB value of less than 10, preferably <8, more preferably <5, e.g. 2 to 5, (b) at least one further non-ionic emulsifier having an HLB value of more than 10, preferably >12, preferably from 12 to 20 (e.g. 15 to 18), (c) at least one anionic co-emulsifier, (d) one oil component having a surface tension of at least 20 mN/m or a mixture of oil components wherein at least 75 weight-% of the oils constituting the mixture have a surface tension of at least 20 mN/m, (e) 6 to 35 weight % of water, based on the total weight of the emulsion, (f) optionally at least one consistency regulator, (g) optionally at least one humectant, and (h) optional further additives.

1.2. Nonionic O/W emulsifier

The emulsifier or emulsifier composition is of a non-ionic type and primarily has the function of forming an oil-in-water emulsion. It can also contribute to the softness of tissue paper. It can be suitably selected from known non-ionic O/w emulsifiers or combination thereof.

The emulsifier (combination) can be selected from the group of hydrophilic O/W emulsifiers. These hydrophilic emulsifiers may have an HLB value of 10 to 20. Such emulsifiers are known from the prior art and some are, for instance, listed in Kirk-Othmer, Enclypedia Of Chemical Technology, third edition, 1979, volume 8, page 913. According to the invention, the HLB value for ethoxylated products may also be calculated according to the formula: HLB=(100−L):5, wherein L is the weight percentage of hydrophilic groups, e.g. fatty alkyl or fatty acyl groups present in the ethoxylated products.

It is also possible to combine less polar and strongly polar emulsifiers such as emulsifiers (a) and (b) explained below:

(a) at least one non-ionic emulsifier having an HLB value of less than 10, preferably <8, more preferably <5, e.g. 2 to 5.

(b) at least one further non-ionic emulsifier having an HLB value of more than 10, preferably >12, preferably from 12 to 20 (e.g. 15 to 18).

The overall content of the (O/W) emulsifier (combination) is preferably 2 to 15% by weight, for instance 1 to 7.5 weight-% (a) and 1 to 7.5 weight-% (b).

Preferably, a liquid O/W emulsifier is used, although the use of minor amounts of solid emulsifier is possible depending on the desired viscosity of the resulting lotion composition.

Component (a) preferably represents a liquid polyol polyester wherein a polyol having at least two hydroxy groups is esterified with at least one carboxylic acid having from 6 to 30 carbon atoms (in particular 16 to 22 C atoms) and having at least one hydroxy group or condensation products of this hydroxy fatty acid. Polyols include monosaccharides, disaccharides, and trisaccharides, sugar alcohols, other sugar derivatives, glycerol, and polyglycerols, e.g. diglycerol, triglycerol, and higher glycerols. Such polyol preferably has from 3 to 12, in particular 3 to 8 hydroxy groups and 2 to 12 carbon atoms (on average, if it is a mixture as in polyglycerols). The polyol preferably is polyglycerol, in particular that having the specific oligomer distribution described in WO 95/34528 (page 5).

The carboxylic acid used in the polyol polyester preferably is a fatty acid having from 6 to 30 carbon atoms (Hereinafter, unless stated otherwise, the term "fatty acid" is not limited to the naturally occurring, even-numbered, saturated or unsaturated long-chain carboxylic acids, but also includes their uneven-numbered homologues or branched derivatives thereof). The fatty acid contains at least one hydroxy group. It can be a mixture of hydroxy fatty acids or a condensation product thereof (poly(hydroxy fatty acids)). The preferred carbon range for the above mentioned hydroxy fatty acid is from 16 to 22, in particular 16 to 18. A particularly preferred poly(hydroxy fatty acid) is the condensation product of hydroxy stearic acid, in particular 12-hydroxy stearic acid, optionally in admixture with poly(ricinoleic acid), said condensation product preferably having the properties described in WO 95/34528.

Preferred emulsifiers include the polyol poly(hydroxystearates), preferably polyol poly(12-hydroxystearates) described in WO 95/34528, in particular polyglycerol poly (hydroxystearates) having the characteristics disclosed in this document, e.g. polyglycerol-2 dipolyhydroxystearate, being available from Cognis Deutschland GmbH under the tradename Dehymuls® PGPH.

Component (b) is preferably selected from (b-1) to (b-6) and mixtures thereof:

(b-1) ethylenoxide or propylenoxide adducts of fatty alcohols having from 8 to 24 C atoms (in particular 12 to 22 C atoms), (C8-C15 alkyl)-phenol or polyols, containing 2 to 50 mol ethylenoxy and/or 0 to 5 mol propylenoxy units.

(b-2) Mono- or diesters (or mixtures thereof) derived from glycerol, poly-, oligo- or monosaccharides, sugar alcohols or sugar alcohol anhydrides (such as sorbitan), and linear or branched, saturated or unsaturated fatty acids having preferably 6 to 22 carbon atoms. These esters may also be ethoxylated (→EO units), e.g. polysorbate monolaurate+20 EO or polysorbate mono-oleate+20 EO. If the ester is to be liquid, the fatty acid can often be selected from short chain saturated fatty acid, e.g. as in sorbitan monolaurate or from fatty acids having at least one unsaturated fatty acid, as in sorbitan sesquioleate. More preferably, component (b-2) represent $C_{12/18}$ fatty acid monoesters and diesters of addition products of 1 to 50 mol ethylene oxide onto glycerol;

(b-3) C12 to 18 fatty acid monoesters and diesters of addition products of 1 to 50 mol ethylene oxide onto glycerol.

(b-4) An alkyl mono-, oligo- and/or polyglycoside, preferably an alkyl mono- or oligo glycoside having 6 to 22 carbon atoms in the alkyl group and alkoxylated, preferably ethoxylated derivates thereof.

An alkyl(mono or oligo)glycoside is a nonionic surfactant wherein at least one hydroxy group (typically the C1 hydroxy of the first glycosyl) of a (mono or oligo)glycoside is linked via at least one ether bond (or ethyleneoxi and/or propyleneoxi units) with an alkyl group-bearing unit (preferably 6 to 28 C atoms in total). The alkyl(mono or oligo) glycoside preferably has the following generic structure (II):

$$R^2O(C_nH_{2n}O)_t(\text{glycosyl})_x \quad \text{(II)}$$

wherein $R^2$ is selected from the group consisting of alkyl, alkylphenyl, hydroxyalkyl, hydroxyalkylphenyl, and mixtures thereof in which the alkyl group contains from 6 to 22 carbon atoms, in particular from 8 to 16 carbon (e.g. 10 to 14 carbon atoms); n is 2 or 3, preferably 2, t is from 0 to about 10, preferably 0; x is at least 1, preferably from 1.1 to 5, more preferably 1.1 to 1.6, in particular 1.1 to 1.4, and "glycosyl" is a monosaccharide. The x value is to be understood as the average content of monosaccharide units (oligomerization degree).

The production of alkyl(oligo)glycoside useful in the present invention is known from the prior art and described, for instance in U.S. Pat. No. 4,011,389, U.S. Pat. No. 3,598,865, U.S. Pat. No. 3,721,633, U.S. Pat. No. 3,772,269, U.S. Pat. No. 3,640,998, U.S. Pat. No. 3,839,318, or U.S. Pat. No. 4,223,129.

To prepare these compounds, the alcohol or alkyl-polyethoxy alcohol is typically first formed and then reacted with the (oligo)glycosyl unit to form the (oligo)glycoside (attachment at the 1-position). The glycosyl units can be attached between the C1 position of further glycosyl(s) and the alkyl-group-bearing glycosyl unit's 2-, 3-, 4- and/or 6-position, preferably 6-position.

Preferred starting alcohols $R^2OH$ are primary linear alcohols or primary alcohols having a 2-methyl branch. Preferred alkyl residues $R^2$ are for instance 1-octyl, 1-decyl, 1-lauryl, 1-myristyl, 1-cetyl, and 1-stearyl, the use of 1-octyl, 1-decyl, 1-lauryl, and 1-myristyl being particularly preferred.

Alkyl(oligo)glycosides useful in the invention may contain only one specific alkyl residue. Usually, the starting alcohols are produced from natural fats, oils or mineral oils. In this case, the starting alcohols represent mixtures of various alkyl residues.

In four specific (preferred) embodiments alkyl(oligo)-glycosides are used, wherein R2 consists essentially of C8 and C10 alkyl groups, C12 and C14 alkyl groups, C8 to C16 alkyl groups, or C12 to C16 alkyl groups.

It is possible to use as sugar residue "(glycosyl)x" any mono- or oligosaccharide. Usually, sugars having 5 or 6 carbon atoms as well as the corresponding oligosaccharides are used. Such sugars include, for instance glucose, fructose, galactose, arabinose, ribose, xylose, lyxose, allose, altrose, mannose, gulose, idose, talose and sucrose. It is preferred to use glucose, fructose, galactose, arabinose, sucrose as well as their oligosaccharides, (oligo)glucose being particularly preferred.

In a preferred embodiment "laurylglucoside", a C12-C16 fatty alcohol-glucoside (x=1.4), which can be obtained from Cognis Deutschland GmbH under the tradename Plantacare®, is used.

(b-5) partial esters based on linear, branched, unsaturated or saturated $C_{6-22}$ fatty acids, ricinoleic acid and 12-hydroxystearic acid and glycerol, polyglycerol, pentaerythritol, dipentaerythritol, sugar alcohols, alkyl glucosides and polyglucosides; or (b-6) polysiloxane/polyalkyl/polyether copolymers and corresponding derivatives; and mixtures thereof.

Of particular advantage from the group of O/W emulsifiers are, for example, Ceteareth-12, Ceteareth-20, PEG-30 Stearate, PEG-20 Glyceryl Stearate, PEG-40 Hydrogenated Castor Oil and Polysorbate 20.

Preferably, the weight ratio of non-ionic emulsifier (a) to further non-ionic emulsifier (b) is in the range of 1:0.5 to 1:2, preferably in the range of 1:0.7 to 1:1.5, most preferably in the range of 1:0.8 to 1:1.2.

Possible non-ionic emulsifiers are the following:

(1) products of the addition of 2 to 50 mol ethylene oxide and/or 0 to 20 mol propylene oxide onto linear fatty alcohols containing 8 to 40 carbon atoms, onto fatty acids containing 12 to 40 carbon atoms and onto alkylphenols containing 8 to 15 carbon atoms in the alkyl group;

(2) $C_{12/18}$ fatty acid monoesters and diesters of addition products of 1 to 50 mol ethylene oxide onto glycerol;

(3) glycerol mono- and diesters and sorbitan mono- and diesters of saturated and unsaturated fatty acids containing 6 to 22 carbon atoms and ethylene oxide addition products thereof;

(4) alkyl mono- and oligoglycosides containing 8 to 22 carbon atoms in the alkyl group and ethoxylated analogs thereof;

(5) addition products of 7 to 60 mol ethylene oxide onto castor oil and/or hydrogenated castor oil;

(6) other polyol esters and, in particular, polyglycerol esters other than polyol poly-12-hydroxystearates such as, for example, polyglycerol polyricinoleate or polyglycerol dimerate;

(7) addition products of 2 to 60 mol ethylene oxide onto castor oil and/or hydrogenated castor, oil;

(8) partial esters based on linear, branched, unsaturated or saturated $C_{6-22}$ fatty acids, ricinoleic acid and 12-hydroxystearic acid and glycerol, polyglycerol, pentaerythritol, -dipentaerythritol, sugar alcohols (for example sorbitol), alkyl and/or alkenyl glucosides (for example methyl glucoside, butyl glucoside, lauryl glucoside) and polyglucosides (for example cellulose);

(9) wool wax alcohols;

(10) polysiloxane/polyalkyl/polyether copolymers and corresponding derivatives;

(11) mixed esters of pentaerythritol, fatty acids, citric acid and fatty alcohol and/or mixed esters of fatty acids containing 6 to 22 carbon atoms, methyl glucose and polyols, preferably glycerol or polyglycerol, and

(12) polyalkylene glycols.

1.2. Anionic Co-Emulsifier

The emulsion/lotion used in the present invention also contains an anionic co-emulsifier as essential component. This anionic co-emulsifier (c) is preferably present in an amount of 0.01 to 10 wt.-%, more preferably 0.05 to 5 wt.-%, in particular 0.03 to 1.4 wt.-%, based on the total weight of the emulsion.

The anionic co-emulsifiers to be used in the O/W emulsion of the present invention are characterized by a water-solubilizing anionic group, such as for example a phosphate, sulphate, carboxylate or sulfonate group, and a lipophilic residue. Even though this is not always mentioned in the following, the anionic co-emulsifier must also comprise for reasons charge neutrality a positive counter ion which is preferably selected from hydrogen, ammonium and alkali metals such as sodium or potassium. Accordingly, the anionic co-emulsifier is employed in salt form.

Dermatologically compatible anionic emulsifiers are known to the expert in large numbers from relevant manuals and are commercially available. More particularly, they are alkyl sulfates in the form of their alkali metal, ammonium or alkanolammonium salts, alkyl ether sulfates, alkyl ether carboxylates, acyl isethionates, acyl sarcosinates, acyl taurines with linear C12-18 alkyl or acyl groups and sulfosuccinates and acyl glutamates in the form of their alkali metal or ammonium salts. In a preferred embodiment of the invention the alkali metal salts of fatty acids, alkyl sulphate and alkyl phosphates are used with an alkyl moiety of C 12 to C 22. Among the anionic surfactants, alkali metal salts of fatty acids (such as e.g. sodium stearate, alkali metal salts of palmitic acid or behenic acid) and, in particular, alkyl sulfates (Lanette® E) and alkyl phosphates (Amphisol® K) are particularly suitable according to the invention because they lead to particularly stable and homogeneous emulsions. The term "fatty acid", as used in this context, is not restricted to the naturally occurring even numbered saturated and unsaturated long chain carboxylic acids. It also comprises uneven numbered homologues, as well as blanched or substituted derivates thereof. It is preferred to use saturated linear fatty acids such as lauric acid, myristic acid, palmitic acid or stearic acid. The amino acid can be any naturally occurring amino acid or synthetic analogue thereof including for instance alanine, valine, leucine, isoleucine, glycerine, serine, treonine. The amino acid is preferably selected from dicarboxylic acids having from 3 to 8 carbon atoms and one amino function such as glutamic acid or asparaginic acid (Asp).

Acyl glutamates are known anionic emulsifiers, e.g. corresponding to the following formula

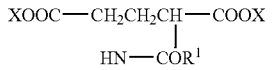

in which $R^1CO$ is a linear or branched acyl radical containing 6 to 22 carbon atoms and 0 and/or 1, 2 or 3 double bonds and X is hydrogen, an alkali metal and/or alkaline earth metal, ammonium, alkylammonium, alkanolammonium (e.g. triethanolammonium) or glucammonium. They are produced, for example, by Schotten-Baumann acylation of glutamic acid with fatty acids, fatty acid esters or chlorides. Corresponding commercial products are available, for example, from Hoechst AG, Frankfurt, Germany or from the Ajinomoto Co. Inc., Tokyo, Japan. An overview of the production and properties of acyl glutamates was published by M. Takehara et al. in J. Am. Oil. Chem. Soc., 49, 143 (1972). Typical examples of suitable acyl glutamates suitable for the purposes of the invention are anionic surfactants derived from fatty acids containing 6 to 22 and preferably 12 to 18 carbon atoms, for example C 12/14 or C 12/18 cocofatty acid, lauric acid, myristic acid, palmitic acid and/or stearic acid. Sodium or potassium N-cocoyl and sodium or potassium N-stearoyl-L-glutamate are particularly preferred. Triethanolamine-salts of acyl glutamates are also preferred, especially the triethanolamine salt of N-cocoylglutamate and the triethanolamine salt of N-stearoyl-L-glutamate.

In a preferred embodiment of the invention the anionic co-emulsifier is present in an amount of 0.01 to 10, preferably 0.05 to 5 weight-%, preferably 0.03 to 1.4 weight-% based on a total weight of the O/W emulsion.

The anionic co-emulsifier is preferably an acylglutamate or acylaspariginate wherein the acyl residue may also be derived from other carboxylic acids than the above-mentioned fatty acids. More preferably, the anionic core emulsifier is an acyl glutamate, preferably a stearoyl glutamate such as the commercially available sodium stearoylglutamate.

The anionic co-emulsifier is preferably present in an amount of 1 to 20 wt.-% based on the amount of the at least one further non-ionic emulsifier (b).

The anionic co-emulsifier helps to stabilize the O/W emulsion, in particular if the same contains a major amount of medium polar oils, for instance hydrocarbon-based oils such as mineral oil. Moreover, without wishing to be bound by theory, it would appear that the anionic co-emulsifier, in cooperation with the other emulsion component, also contributes to suppression of undesired smells.

1.3. Oil Component

Component (c) of the emulsion/lotion is an oil component having a surface tension of at least 20 mN/m or a mixture of oil components wherein at least 75 weight-% of the oils constituting the mixture have a surface tension of at least 20 mN/m. Oils having a lower surface tension tend to develop undesired smells over longer periods of storage. The surface tension of an oil component is defined as the surface tension (surface tension index) of an oil against water. The surface tension of oil can be determined using a ring tensiometer (e.g. Krüss K 10), measuring the boundary layer energy, which is the boundary layer tension in mN/m. The lower limit is 5 mN/m. The method is suitable for low viscosity liquids given that a boundary layer is present (that is the liquids are not miscible). The surface tension of the oil is determined against water.

The term "oil" is used for water-insoluble, organic, natural and synthetic, cosmetically useful oils having emollient properties and preferably a liquid (also viscous) consistency at room temperature (23°).

Preferably, the oil or mixture of oils is present in an amount of 20 to 80 weight %, more preferably 30 to 75 weight-%, in particular 40 to 70 weight-%, based on the total weight of the emulsion.

Oil components having the required polarity are for instance liquid hydrocarbon-based oils such as mineral oil, synthetic triglyceride mixtures, vegetable oils, guerbet alcohols, liquid linear or branched carboxylic acid esters, liquid substituted cyclohexanes, symmetric or asymmetric dialk(en)ylethers having from 6 to 22 C atoms per alk(en)yl group, linear or branched dialk(en)ylcarbonates derived from 6 to 22

C atoms fatty alcohols, ring-opening products or epoxidized fatty acid esters and polyols, silicone oils and mixtures thereof.

The following table lists the polarity for the most common oils.

| Common Oils (CFTA-terms) | Surface tension index (mN/m) |
|---|---|
| Non-polar | |
| Isoparaffin (C12-C14) | 53.0 |
| Squalan | 46.2 |
| Isohexadecane (ARLAMOL ND) | 43.8 |
| Mineral oil (Paraffin oil perliquidum | 43.7 |
| Mineral oil (Paraffin oil subliquidum | 38.3 |
| Polar | |
| Cetylstearyloctanoate (purceline oil) | 28.6 |
| Dimethicone (silicon oil 20 cSt) | 26.6 |
| Isopropylpalmitate | 25.2 |
| Octyldodecanol | 24.8 |
| Dioctyladipate (ARLAMOL DOA) | 24.5 |
| Isopropylmyristate | 24.2 |
| Octylpalmitate (2-ethylhexylpalmitate) | 23.1 |
| Hexamethyldisiloxane | 22.7 |
| Isopropylstearate | 21.9 |
| Capryl/caprine acid triglyceride (neutral oil) | 21.3 |
| Isopropylisostearate | 21.2 |
| Jojoba oil | 20.8 |
| Cyclomethicone (ARLAMOL D4) | 20.6 |
| Peanut oil | 20.5 |
| Almond oil | 20.3 |
| Sunflower oil | 19.3 |
| Decyloleate | 18.7 |
| Avocado oil | 18.3 |
| Olive oil | 16.9 |
| Castor oil | 13.7 |
| Calendula oil | 11.1 |
| Wheat germ oil | 8.3 |

Preferred embodiments of the oil component to be used in the present invention are illustrated below.

Suitable hydrocarbon-based oils are known to a person skilled in the art. They have preferably 8 to 32, more preferably 12 to 25, in particular 15 to 20 carbon atoms, such as squalane, squalene, paraffinic oils, isohexadecane, isoeicosane, polydecene or dialkycyclohexane. Mineral oil usually refers to less viscous mixtures of hydrocarbons having from 16 to 20 carbon atoms. Mineral oil is a particularly preferred oil.

Liquid synthetic glycerides are mono-, di- and/or tri ester (fatty acid ester) of glycerol (in particular di- and/or triester). Preferably the fatty acid component has from 6 to 24, more preferably 6 to 18, in particular 8 to 18 carbon atoms. The fatty acid can be branched or unbranched as well as saturated or unsaturated, saturated fatty acids being preferred. According to the invention, the use of liquid glycerides from plant source is preferred, in particular the use of a modified liquid coconut oil (INCI name: cocoglycerides, available under the trade name Myritol® 331 from Cognis Deutschland GmbH) which contains as main component a mixture of di- and triglycerides based on C8 to C18 fatty acids.

Vegetable oils which may contain liquid glycerides as main component, such as soja oil, peanut oil, olive oil, macademia nut oil or jojoba oil.

Guerbet alcohols are based on fatty alcohols having 6 to 18, preferably 8 to 10 carbon atoms, such as 2-ethylhexanol or 2-octyldodecanol.

Liquid linear or branched carboxylic acid esters, preferably fatty acid esters are more preferably esters of monovalent carboxylic acids having at least one long chain alkyl or acyl residue (each having at least 6 C atoms, in particular at least 12 C atoms). Preferred carboxylic ester type emollient oils include those having more than 6 carbon atoms in total, preferably more than 12 C atoms in total which comprise either an acyl or an alkyl residue having each 1 to 5 carbon atoms. According to even more preferred embodiments, the carboxylic acid ester has the following formula (I)

$$R^1COO—R^2$$

wherein (i) $R^1CO$ represents an acyl residue having 6 to 28 carbon atoms, and $R^2$ represents an alkyl residue having 1 to 5 carbon atoms or (ii) $R^1CO$ represents an acyl residue having 1 to 5 carbon atoms, and $R^2$ represents an alkyl residue having 6 to 28 carbon atoms.

In line with option (i), the acyl residue may be saturated or unsaturated (e.g. 1,2,3 double bonds), the saturated embodiments being preferred. The acyl residue, preferably the saturated acyl residue may be branched and is optionally substituted, although this is not preferred. Similarly, the alkyl residue, may be branched as in isopropyl and/or substituted. The acyl residue preferably has 12 to 22 carbon atoms, in particular, 14 to 20 carbon atoms. The alkyl residue preferably has 1 to 3 carbon atoms as in methyl, ethyl or (iso)propyl. Representative examples of such esters include methylpalmitate, methyl stearate, isopropyl laurate, isopropyl myristate, and isopropyl palmitate.

In line with option (ii) the acyl residue may be branched and/or substituted for instance by hydroxy. According to one embodiment of option (ii), the acyl residue has 2 to 4 carbon atoms. The alkyl residue preferably has 12 to 22 carbon atoms, in particular 14 to 20 carbon atoms. It may be saturated or unsaturated (e.g. one, two or three double bonds), saturated embodiments being preferred. Moreover, the alkyl residue may also be branched and/or substituted. Suitable fatty ester emollients of type (ii) include lauryl lactate and cetyl lactate.

Substituted cyclohexanes, in particular substituted cyclohexanes.

Symmetric or asymmetric, linear or branched dialk(en)ylethers having from 6 to 22 carbon atoms (per alk(en)yl group, preferably having 12 to 24 C atoms as total number of C atoms), such as di-n-octylether (dicaprylylether), di-(2-ethylhexyl)ether, laurylmethylether, octylbutylether or didocecylether.

Dialk(en)ylcarbonates having preferably at least one C6 to 22 alkyl or alkenyl group (preferred total number of C atoms: not more than 45 including the C atom for the carbonate unit). The alkyl or alkenyl group can be straight or branched. The alkenyl unit may display more than one double bond. These carbonates can be obtained by transesterification of dimethyl or diethyl carbonate in the presence of C6 to C22 fatty alcohols according to known methods (cf. Chem. Rev. 96, 951 (1996)). Typical examples for dialk(en)ylcarbonates are the (partial) transesterification products of caprone alcohol, capryl alcohol, 2-ethylhexanol, n-decanol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachidyl alcohol, gadoleyl alcohol, behenyl alcohol, erucyl alcohol and brassidyl alcohol as well as their technical mixture, which are for instance obtained by high pressure hydrogenisation of technical methyl esters on fat or oil basis. Particularly suitable in view of their low viscosity at 20° C. are dihexyl-, dioctyl-, di-(2-ethylhexyl)- or dioleylcarbonat. Thus it is preferred to use either short chain (C6 to C10) alkyl or alkenyl carbonates.

Ring-opening products of epoxidized fatty acid esters and polyols.

Cosmetically useful silicone oils (e.g. those of U.S. Pat. No. 4,202,879 and U.S. Pat. No. 5,069,897).

In a further preferred embodiment, the above oil components are suitably selected among low viscosity oils, i.e. oils having a viscosity of 1-100 mPa·s, in particular 1-50 mPa·s (e.g. 1-20 mPaS) measured with a Höppler falling sphere viscosimeter at 20° C. (method "Deutsche Gesellschaft für Fettchemie" DGF C-IV 7), in order to achieve the desired penetration behavior on tissue paper.

According to one embodiment, the emulsion comprises a mixture of oils and at least 80, preferably at least 90 weight % of the oils constituting the mixture have a polarity of at least 20 mN/m.

According to one preferred embodiment, the emulsion comprises one oil having a polarity of at least 35 mN/m or a mixture of oils wherein at least 30, preferably at least 40, more preferably at least 50 weight % of the oils constituting the mixture have a polarity of at least 35 mN/m.

According to one preferred embodiment, the emulsion comprises a hydrocarbon-based oil, preferably mineral oil as sole oil component or a mixture of (d-1) a hydrocarbon based oil, preferably mineral oil and (d-2) at least one further oil, which is preferably selected from the afore-mentioned oils other than hydrocarbon-based oils.

According to one further preferred embodiment, the hydrocarbon-based oil (d-1), preferably mineral oil constitutes at least 40 weight-%, more preferably at least 50 weight-% of all oil components (d).

The further oil component (d-2) is preferably selected from liquid carboxylic acid esters comprising either an acyl or an alkyl residue having each 1 to 5 carbon atoms.

According to one preferred embodiment, the carboxylic acid ester has the following formula (I)

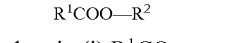

$$R^1COO—R^2 \quad (I)$$

wherein (i) $R^1CO$ represents an acyl residue having 6 to 28 carbon atoms, and $R^2$ represents an alkyl residue having 1 to 5 carbon atoms or (ii) $R^1CO$ represents an acyl residue having 1 to 5 carbon atoms, and $R^2$ represents an alkyl residue having 6 to 28 carbon atoms, option (i) being more preferred.

Option (i) includes the aforementioned more preferred embodiments.

1.4. Water

The lotion composition contains 6 to 35% by weight, preferably 12 to 32% by weight, more preferably 10 to 30% by weight, in particular 20 to 30% by weight of water. The water contributes to a lotion-like pleasant feel to the skin of the user. Water, further, counteracts the tendency of pure humectants (if present) to withdraw water from the human skin. On the other hand, the water content should not be much higher than 35% by weight, since then the mechanical strength of the treated tissue paper may suffer to an undesired extent. Usually, the aqueous phase of the O/W emulsion contains water as a main component. However, if the water content is closer to the lower limit of the claimed range, it is preferred to add a corresponding amount of water-soluble, aqueous phase-forming components, preferably the humectant, to the lotion composition. Otherwise the discontinuous (oil) phase could be in too close contact, in order to maintain a stable O/W emulsion. In view of the above, the weight proportion of the aqueous phase is preferably more than 20, more preferably at least 22, in particular at least 23 weight %, based on the total weight of the lotion composition.

1.5. Humectant (Optional)

The lotion composition preferably comprises from 0.5 to 15% by weight, more preferably 1 to 10% by weight, and in particular 2 to 8% by weight (water-soluble) humectant.

The humectant performs multiple functions. First, it binds water and counteracts the tendency of water to evaporate. Moreover, the humectant can interact with other lotion components and then contributes to the softness of the tissue paper, in particular its bulk softness. The humectant can also influence the rheological properties of the lotion composition.

The humectant preferably is a polyhydroxy compound, which is understood to be an organic compound having at least two hydroxy groups and which preferably consists only of carbon, hydrogen, oxygen and nitrogen, in particular only of C, H and O. It is further desirable that the humectant is not ionic.

Hydrophilic surfactants (having a HLB number of 10 or greater, see for instance U.S. Pat. No. 4,764,418) can have humectant properties. It is preferred according to the invention that the humectant be free of major hydrophobic molecule parts, e.g. fatty acid or fatty alcohol residues.

Further, the humectant preferably has a liquid consistency, even though it is possible to use a minor amount of a solid, low melting point humectant depending on the desired viscosity and penetration behavior of the final lotion.

If liquid humectants are to be employed, the molecular weight (weight average) preferably is less than 1,000, more preferably less than 800, and in particular not more than 600.

Examples of suitable humectants include: amino acids, pyrrolidone, carboxylic acid, lactic acid and salts thereof, lactitol, urea and urea derivatives, uric acid, glucosamine, creatinine, cleavage products of collagen, chitosan or chitosan salts/derivatives and, in particular, polyols and polyol derivatives (for example glycerol, diglycerol, triglycerol, polyalkylene glycols, e.g. polypropylene glycol, butylene glycol, 1,2,6-hexanetriol, polyethylene glycols, for instance polyethylene glycol having a weight average molecular weight of from about 200 to 600); neopentyl alcohols such as pentaerythritol or neopentyl glycol; sugar alcohols such as threitol, erythritol, adonitol (ribitol), arabitol, xylitol, dulcitol, maltitol, mannitol, inositol and sorbitol, carbohydrates such as D (+)-glucose, D (+)-fructose, D (+)-galactose, D (+)-mannose, L-gulose, saccharose, galactose, maltose, polyglycerols, polyoxypropylene adducts of glycerol, methoxypolyethylene glycol, polyethylene glycol ethers of sugar alcohols, such as sorbitol, polyethylene glycol ethers of glycerol, ethoxylated sorbitol (Sorbeth-6, Sorbeth-20, Sorbeth-30, Sorbeth-40), honey and hydrogenated honey, hydrogenated starch hydrolyzates and mixtures of hydrogenated wheat protein and PEG-20-acetate copolymer, and combinations thereof. Hyaluronic acid may also be used as humectant.

Preferred humectants are glycerol, diglycerol and triglycerol, and particularly preferred is glycerol.

1.6. Consistency Regulators (Optional)

The viscosity of a lotion can be adjusted by using a corresponding amount of consistency regulators, which are typically solid.

The amount of consistency regulators depends on the desired viscosity of the final lotion composition. If a semi-solid consistency is to be obtained, the consistency regulators can be used in amounts of up to 30% by weight, for instance 5 to 20% by weight.

On the other hand, if it is intended to produce a low viscosity lotion composition which fully penetrates the fibrous web, lower amounts of consistency regulators should be used. In this case, the overall content of solid components, including the consistency regulators is preferably less than 15% by weight, more preferably less than 10% by weight, in particular less than 5% by weight, e.g. 0.1 to 5% or 1 to 5% by weight.

The consistency regulator is suitably selected from solid, mono-, di- and triglycerides and mixtures thereof, solid fatty alcohols, waxes, as well as metal soaps. Preferred embodiments thereof are explained in the following:

Glycerides are preferably the mono-, di- and/or triester of glycerol and fatty acids having from 6 to 30, in particular, 16 to 30 carbon atoms, whereby the term "fatty acid" is not restricted to the naturally occurring even-numbered, saturated and unsaturated carboxylic acids, but also includes their uneven-numbered homologues and isomers thereof. A skilled person can suitably select among known glycerides those having a solid consistency at 23° C., whereby the degree of esterification and unsaturation plays an important role. Usually, it is preferred to use glycerides wherein the fatty acid residues are predominantly saturated. In a more preferred embodiment, commercial mono-, di- and/or triglyceride (mixtures) are used, which are available from Cognis Deutschland GmbH under the tradenames Cutina® GMS or MD, or Novata® AB. Syncrowax® HGLC (available from Croda) may also be used. Particularly preferred is a glyceryl stearate (predominantly mono- and diester, some triester), which is marketed by Cognis Deutschland GmbH under the tradename Cutina® MD.

Metal Soaps:

A metal soap of the following formula may be used:

$$(R^1COO)_n—X$$

wherein $R^1$ represents a linear, saturated, or unsaturated acyl residue having 6 to 22 carbon atoms and optionally at least one hydroxy group, preferably 12 to 18 carbon atoms, X is an alkali metal (e.g. Li), earth alkali metal (e.g. Ca, Mg), or Al or Zn, and n is the valence of X. Preferred examples of the metal soap involve zinc, calcium, magnesium or aluminum stearate.

Wax:

The term "wax" is used as in the prior art for natural or synthetic materials which have a kneadable, solid or brittle consistency at room temperature, are finely to granularly crystalline, however not glass-like, and transparent to opaque. Useful waxes melt at a temperature above 35° C. without decomposition and then (slightly above the melting point) have a fairly low viscosity (sometimes referred to as "lipophilic" waxes). Useful waxes are listed in DE-A 199 06 081.

Fatty Alcohols:

Preferred fatty alcohols are those having at least 12, preferably 12 to 30 C atoms (e.g. C12-C24 or C24-C30), in particular the saturated embodiments thereof. Examples thereof involve lauryl alcohol, myristyl alcohol, cetearyl alcohol, erucyl alcohol, ricinol alcohol, isostearyl alcohol, arachidyl alcohol, behenyl alcohol, brassidyl alcohol as well as their guerbet alcohols. Further, it is possible to use fatty alcohol mixtures obtained by the reduction of naturally occurring fats and oils, such as beef tallow, peanut oil, rape oil, cotton seed oil, soy oil, sunflower oil, palm kernel oil, linseed oil, castor oil, corn oil, sesame oil, cocoa butter and coco oil. However, it is also possible to use synthetic alcohols such as the linear, even-numbered fatty alcohols obtained by Ziegler synthesis (Alfole®) or the partially branched alcohols by oxosynthesis (Dobanole®).

It is also possible to use mixtures of these fatty alcohols, for instance the mixture of cetyl alcohol and stearyl alcohol which is commercially available as "cetearyl alcohol".

According to a particularly preferred embodiment of the present invention, the consistency regulator is selected from fatty alcohols, such as cetearyl alcohol.

1.7. Additives (Optional)

Optionally, the lotion composition may contain up to 10% by weight, in particular 0.1 to 5% by weight additives, such as Preservatives which stabilize the lotion composition, such as methylisothiazolin(on) which may have a chlorine as substituent, e.g. 5-chloro-2-methyl-4-isothiazolin-3-on or 2-methyl-4-isothiazolin-3-on; phenoxyethanol or PHB ester, paraben preservatives, pentanediol, sorbic acid or other compounds as mentioned in "Kosmetikverordnung, Anlage 4, Teil A und B".

Germicidal agent(s), e.g. those described in DE-199 06 081 A.

Cosmetic agents, preferably from natural sources (plant extracts), having for instance a skin-soothing, antiphlogistic (reduction of skin irritation), wound-healing, cell-regenerating, anti-inflammatory and/or anti-itch effect such as allantoin; aloe vera extract; aloe barbadensis extract; chamomile extract containing azulene and α-bisabolol; echinacea; dragosantol; panthenol; liquorice root extract containing 18-glycyrrhetinic acid; lime tree extract containing quercetin and/or glyco-rutin; marigold (calendula oil); urea; phytosterols, optionally ethoxylated (available from Henkel under the tradename "Generol"); chitosan (acetylated chitin); anthocyanidins; gingko leaf extract containing quercetin and rutin; horse chestnut containing quercetin and campherol; vitamins or provitamins such as provitamin B5 or Vitamin E; avocado oil; birch extract; arnica; extract of rose of Sharon or St. John's wort; teatree oil; cucumber, hops, or hamamelis extracts or ingredients, ethoxylated quaternary amines (itching inhibitor useful for lotioned toilet papers); the use of α-bisabolol being preferred;

Perfume e.g. those described in DE 199 06 081; and/or

Cosmetically useful Dyes and pigments, e.g. those described in "Kosmetische Färbemittel" (Cosmetic Colouring Agents), published by the Farbstoffkommission der Deutschen Farbstoff-gemeinschaft; Verlag Chemie, Weinheim, 1984, p. 81-106.

The above-mentioned cosmetic agent is normally present in a quantity of 0.01 to 10 weight-%, preferably 0.1 to 7 weight-%, and more particularly 1 to 5 weight-%. The emulsion to be used in the present invention preferably contains, as a cosmetic agent, at least one irritation-soothing/anti-inflammatory agent, which is intended in particular to sooth inflammatory skin processes or reddened, sore skin.

According to the invention, bisabolol, allantoin and panthenol and bisabolol are particularly preferred as cosmetic agents. Vitamins and vitamin precursors and protein hydrolyzates can also promote wound healing.

Also suitable are plant extracts which often contain a synergistic combination of wound-healing/irritation-soothing substances. These extracts are normally obtained by extraction of the whole plant. In individual cases, however, it can also be preferred to prepare the extracts exclusively from flowers and/or leaves of the plant.

As far as the plant extracts suitable for use in accordance with the invention are concerned, reference is made in particular to the extracts listed in the Table beginning on page 44 of the 3rd Edition of the Leitfaden zur Inhaltsstoffdeklaration kosmetischer Mittel, published by the Industrieverband Körperpflege-und Waschmittel e.V. (IKW), Frankfurt.

According to the invention, the extracts of, above all, camomile, aloe vera, hamamelis, lime blossom, horse chestnut, green tea, oak bark, stinging nettle, hops, burdock root, horse willow, hawthorn, almond, pine needle, sandalwood, juniper, coconut, mango, apricot, lemon, wheat, kiwi, melon, orange, grapefruit, sage, rosemary, birch, mallow, lady's smock, creeping thyme, yarrow, thyme, balm, restharrow, coltsfoot, hibiscus, meristem, ginseng and ginger root are suitable.

One preferred type of cosmetic agents are plant extracts of the type as already mentioned above which often contain one or more wound-healing/soothing agents. Typically these extracts are prepared by extracting the entire plant. In some cases it can also be preferred to use solely the blossom and/or leaves of the plant. Preferred extracts are obtained from chamomile aloe Vera, hamamelis, lime-blossom, sage and melissa. It is a particular merit of the present invention that plant extracts can be used without undesired colouring reactions of the emulsion.

Suitable extraction agents for the preparation of the plant extracts to be mentioned are water, alcohols and mixtures thereof. Among the alcohols, lower alcohols, such as ethanol and isopropanol, but especially polyhydric alcohols, such as ethylene glycol and propylene glycol, are preferably used both as sole extractant and in the form of mixtures with water, Plant extracts based on water/propylene glycol in a ratio of 1:10 to 10:1 have proved to be particularly suitable.

The above additives may be used separately or in combination.

1.8. Most Preferred Lotion

The most preferred lotion composition, which based on current knowledge reflects the best mode for carrying out the invention, comprises the following components:

(a) 2 to 15 weight-%, preferably 3 to 7 weight-% of a polyol polyester wherein a polyhydric alcohol having at least two hydroxy groups is esterified with at least one acid having from 6 to 30 carbon atoms and at least one hydroxy group or condensation product(s) of this hydroxy fatty acid, (b) 2 to 15 weight-%, preferably 3 to 7 weight-% of at one further non-ionic emulsifier, preferably at least one alkyl mono-, oligo- or polyglycoside, (c) 0.01 to 10 weight-%, preferably 0.03 to 1.4 weight-% of at least one anionic emulsifier, preferably of carboxylate type, (d) 40 to 70 weight % of an oil component having a surface tension of at least 20 mN/m or a mixture of oil components wherein at least 75 weight-% of the oils constituting the mixture have a surface tension of at least 20 mN/m, (e) 12 to 32 weight % water, (f) optionally 1 to 5 weight-% of at least one consistency regulator, (g) optionally 1 to 5 weight-% humectant, (h) optionally 0.1 to 5 weight-% further additives, preferably at least one irritation-soothing agent.

More preferably, the emulsion comprises (d) a mixture of (d-1) at least one hydrocarbon-based oil such as mineral oil and (d-2) at least one further oil selected from those defined above. Even more preferably, the further oil (d-2) is a carboxylic acid ester represented by formula (I)

$$R^1COO—R^2 \quad (I)$$

wherein $R_1CO$ represents an acyl residue having 6 (more preferably 12) to 22 carbon atoms and R2 represents an alkyl residue having 1 to 5 carbon atoms.

2. Preparation of Lotion

The lotion composition (oil-in-water emulsion) can be prepared according to known methods (see for instance Karlheinz Schrader, Grundlagen und Rezepturen der Kosmetika, Hüthig Buch Verlag Heidelberg, Second Edition, 1989, pages 906 to 912).

One (low temperature) procedure which is only applicable if there are no solid components requiring melting for even distribution/dissolution involves mixing and homogeneously stirring the oil phase component(s), such as oil components (A) and emulsifier(s) (B) and other optional oil-phase components at room temperature (usually for approximately 10 min). The components of the water phase such as water, humectant, and possible water-soluble or water-dispersible additives such as perfume or preservatives are separately mixed at room temperature and slowly added to the mixture of oil-phase components during continuous stirring. After continued stirring (preferably for approximately 10 min) the resulting mixture is then homogenized (usually for approximately 10 min) with a suitable dispersion device such as supraton or stator-rotor homogenizers of the Ultraturrax type. As known from the prior art, homogenizing conditions may have an impact on the viscosity of the emulsion obtained.

According to one embodiment, which is applicable, if solid components such as consisting regulates require an increased temperature to be evenly distributed/dissolved in the oil phase, the lotion composition is prepared by mixing the oil phase and water phase components at a higher temperature. For this purpose, it is preferred to heat the oil phase and water phase components separately to about 80° C. to 85° C. Then, at this temperature the water phase components are slowly added to the oil phase components while stirring, optionally homogenizing. After continued stirring, preferably for about 5 min, the mixture is allowed to cool while stirring in such a way that it remains in continuous motion. Simultaneously, the incorporation of air should be avoided. The mixture can then be homogenized with a suitable dispersion device such as supraton or stator-rotor homogenizers of Ultraturrax type, preferably at 60° to 65° C., in order to improve stability and structure. After a homogeneous state is reached, the composition is allowed to cool to room temperature. If perfume is added, it is generally preferred to include the same not at the highest preparation temperature, but during the cooling step and preferably before the emulsion has returned to room temperature.

If the viscosity is too high, it is possible for instance to reduce the energy influx during homogenization, in particular by lowering the rotational speed of the rotor/stator system.

3. Tissue Paper to be Treated

In accordance with the present invention, the tissue paper to be lotioned exists in the form of toilet paper, or is further processed to toilet paper after the lotioning step.

The present invention pertains to a toilet paper, that is a tissue paper product intended for sanitary use in a toilet, mainly provided in form of rolls with a certain number of sheets. It may be separated by a perforation line or as folded single sheets, c-folded or interfolded in the institutional area. Products of this type are made using a light weight dry creped, optionally through air dried or a non-creped technique and derive from a single ply, semi-finished, wet-laid tissue base paper that is composed of natural fibers and optionally other fiber materials. The origin of these fibers may be native or recycled. A typical grammage of a single ply tissue paper is from 10 g/m$^2$ up to 50 g/m$^2$.

The toilet paper products are coated or impregnated with the present lotion which provides a cream-like lotion perception.

Preferably the tissue paper contains as main component (in particular at least 80% by weight, relative to the dry weight of the fibrous web, without lotion) cellulosic fibres, in particular pulp, although a proportional use of modified pulp fibers (e.g.

from 10 to 50 weight %, relative to the total weight of the fibers) or the use of synthetic fibers suitable for web making (e.g. from 10 to 30% by weight, relative to the total weight of the fibers) is covered by the invention.

Creped or "uncreped" tissue paper obtained by wet rush transfer as described in the section "Background Art" can be lotioned, the use of creped tissue paper being preferred. The tissue paper (or the final tissue paper product obtained therefrom) can be single-ply or multi-ply (typically 2 to 4). The penetration behavior of a low viscosity lotion can be particular suitable for multi-ply toilet tissue paper, in particular 4-ply embodiments, since the lotion can be almost evenly distributed over the outer and inner plies.

The tissue paper may be homogeneous or layered, wet-pressed or blow-dried (TAD-dried). The tissue paper includes, but is not limited to, felt-pressed tissue paper, pattern-densified tissue paper, uncompacted tissue paper or compacted tissue paper.

The starting material for the production of the tissue paper usually is a fibrous cellulosic material, in particular pulp.

If, however, linters or cotton is used as raw material for the production of tissue paper, usually no further pulping steps are needed. Due to the morphological structure, the cellulose already exists in an open state.

The starting pulps used may relate to primary fibrous materials (raw pulps) or to secondary fibrous materials, whereby a secondary fibrous material is defined as a fibrous raw material recovered from a recycling process. The primary fibrous materials may relate both to a chemically digested pulp and to mechanical pulp such as thermorefiner mechanical pulp (TMP), chemothermorefiner mechanical pulp (CTMP) or high temperature chemithermomechanical pulp (HTCTMP). Synthetic cellulose-containing fibres can also be used. Preference is nevertheless given to the use of pulp from plant material, particularly wood-forming plants. Fibers of softwood (usually originating from conifers), hardwood (usually originating from deciduous trees) or from cotton linters can be used for example. Fibres from esparto (alfa) grass, bagasse (cereal straw, rice straw, bamboo, hemp), kemp fibers, flax, and other woody and cellulosic fiber sources can also be used as raw materials. The corresponding fiber source is chosen in accordance with the desired properties of the end product in a manner known from the prior art. For example, the fibers present in hardwood, which are shorter than those of softwood, lend the final product a higher stability on account of the higher diameter/length ratio. If softness of the product is to be promoted, which is important e.g. for tissue paper, eucalyptus wood is particularly suitable as a fiber source.

With regard to softness of the products, the use of chemical raw pulps is also preferred, whereby it is possible to use completely bleached, partially bleached, and unbleached fibers. The chemical raw pulps suitable according to the invention include inter alia, sulphite pulps, kraft pulps (sulphate process).

Before a raw pulp is used in the tissue making process, it may also be advantageous to allow further delignification to occur in a separate process step or employ a bleaching process to achieve a more extensive removal of lignin after the cooking process and to obtain a completely cooked pulp.

A preferred production process for tissue paper uses a a forming section (for wet-laying a slurry of cellulosic fibrous material, typically pulp) comprising a headbox and wire portion, and b the drying section (TAD (through air drying) or conventional drying on the yankee cylinder) that also usually includes the crepe process essential for tissues.

This is typically followed by c the monitoring and winding area.

The tissue paper can be formed by placing the fibers, in an oriented or random manner, on one or between two continuously revolving wires of a paper-making machine while simultaneously removing the main quantity of water of dilution until dry-solid contents of usually between 12 and 35% are obtained. It is possible to include additives in the paper furnish to improve the wet-strength or dry-strength or other properties of the finished tissue paper.

Drying the formed primary fibrous web occurs in one or more steps by mechanical and thermal means until a final dry-solids content of usually about 93 to 97% is obtained. In the case of tissue making, this stage is followed by the crepe process which crucially influences the properties of the finished tissue product in conventional processes. The conventional dry crepe process involves creping on a drying cylinder having a diameter of usually 4.5 to 6 m, the so-called yankee cylinder, by means of a crepe doctor with the aforementioned final dry-solids content of the base ("raw tissue") tissue paper (wet creping can be used if lower demands are made of the tissue quality). The creped, finally dry base tissue paper is then available for further processing into the paper product or tissue paper product according to the invention.

Instead of the conventional tissue making process described above, the invention gives preference to the use of a modified technique in which an improvement in specific volume is achieved by a special kind of drying within process section b and in this way an improvement in bulk softness of the resulting tissue paper is achieved. This pre-drying process, which exists in a variety of subtypes, is termed the TAD (through air drying) technique. It is characterized by the fact that the "primary" fibrous web (like a non-woven) that leaves the sheet making stage is pre-dried to a dry-solids content of about 80% before final contact drying on the yankee cylinder by blowing hot air through the fibrous web. The fibrous web is supported by an air-permeable wire or belt and during its transport is guided over the surface of an air-permeable rotating cylinder drum. Structuring the supporting imprinting fabric or belt makes it possible to produce any pattern of compressed and uncompressed zones achieved by deflection of the fibres in the moist state, followed by pre-drying (TAD step) and leading the web through a pressure nip between a pressure roll and the Yankee cylinder surface, thereby resulting in increased mean specific volumes and consequently leading to an increase in bulk softness without decisively decreasing the strength of the fibrous web.

Another possible influence on softness and strength of base tissue lies in the production of a layering in which the primary fibrous web to be formed is built up by a specially constructed headbox in the form of physically different layers of fibrous material, these layers being jointly supplied as a pulp jet to the forming stage.

The one-ply intermediate products originating from the paper-making machine and made of lightweight paper usually dry-creped on a yankee cylinder by means of a crepe doctor are generally described as "tissue paper" or more accurately base tissue paper. The one-ply base tissue may be built up of one or a plurality of layers respectively.

All one-ply or multi-ply final products made of base tissue and tailored to the end user's needs, i.e. manufactured with a wide variety of requirements in mind, are known as "tissue products".

When processing the fibrous web or base tissue paper into the final tissue product, the following procedural steps are normally used individually or in combination: cutting to size (longitudinally and/or cross cutting), producing a plurality of plies, producing mechanical and/or chemical ply adhesion, volumetric and structural embossing, folding, imprinting, perforating, smoothing, stacking, rolling up.

To produce multi-ply toilet paper products an intermediate step preferably occurs with so-called doubling in which the base tissue in the finished product's desired number of plies is usually gathered on a common multiply master roll.

The processing step from the base tissue that has already been optionally wound up in several plies to the finished tissue product occurs in processing machines which include operations such as repeated smoothing of the tissue, edge embossing, to an extent combined with full area and/or local application of adhesive to produce ply adhesion of the individual plies (base tissue) to be combined together, as well as longitudinal cut, folding, cross cut, placement and bringing together a plurality of individual tissues and their packaging as well as bringing them together to form larger surrounding packaging or bundles. The individual paper ply webs can also be pre-embossed and then combined in a roll gap according to the foot-to-foot or nested methods.

Embossing can be used for generating ply adhesion in multi-ply tissue papers. In order to ensure that the lotion does not lower the ply adhesion, the embossed regions may be left untreated. Further it is known from U.S. Pat. No. 4,867,831 to use melted thermoplastics to achieve plybonding in lotioned tissue papers.

According to the invention the tissue paper to be treated with the lotion preferably has a basis weight of 10 to 50, more preferably 11 to 40, even more preferably 12 to 20 g/m$^2$ per ply, in particular 13 to 17 g/m2 per ply and a total basis weight (including all plies without lotion) of usually 10 to 80 g/m$^2$.

4. Application of Lotion on the Tissue Paper

As mentioned, lotion application typically takes place after the tissue paper web has been dried. A suitable point in time is for example directly after drying the web, shortly before combining the webs to form multiple plies or before forming the multi-ply web into the final tissue product. However, it is preferred first to laminate at least two single ply webs to a multiply web, followed by application of lotion. For tissue paper having two or more plies, the lotion composition may be applied to each ply or only to one or both outer plies. In a preferred production process for lotioned 4-ply (products), two 2-ply webs are each lotioned on only one side, followed by joining together the untreated sides of said 2-ply webs, thereby obtaining a 4 ply product. It can be preferred to apply the lotion composition to at least one, preferably both outer plies of multi-ply tissue webs, since then the advantageous penetration behavior of a low viscosity lotion composition can fully be developed by achieving a distribution as even as possible with respect to the z-direction (perpendicular) of the multi-ply tissue paper. The individual plies or the multi-ply structure may be patterned either before or after application of the lotion composition. Suitable application techniques include spraying, rotogravure printing or flexographic printing or application by means of rolls having a smooth surface. Preferably, the lotion composition is slightly heated, in particular to a temperature from 30° to 50° C., in particular 32 to 38° C. before it is applied to the web.

Preferably, the lotion is applied in an amount of 1 to 10 g, in particular 2 to 5 g per m$^2$ treated surface, i.e. with the double the amount, if both surfaces are lotioned. The weight ratio lotion composition/web (single or multi-ply, dry weight) is preferably 3 to 30%, more preferably 5 to 20% by weight.

5. Test Method

The capacity of a lotioned tissue paper to sink in water was determined in line with DIN ENV 12625-8 of May 2001 "Tissue paper and tissue products-Part 8: Determination of water absorption time, water absorption capacity—manual and automated test method", which is identical with the method described in further detail in WO 02/057547 A2.

6. Example

A lotion composition containing the following ingredients was prepared at increased temperature as described above.

TABLE 1

| Component | % by weight |
|---|---|
| Mineral oil | 35.0 |
| Isopropyl Palmitate | 26.2 |
| Aqua | 23.9 |
| Polyglyceryl-2 Dipolyhydroxystearate | 4.0 |
| Lauryl Glucoside | 4.0 |
| Glycerin1 | 3.0 |
| Cetearyl Alcohol | 3.0 |
| Perfum Oil | 0.5 |
| Sodium Stearoyl Glutamate | 0.1 |
| *Aloe Barbadensis* Leaf Extract | 0.1 |
| *Chamomilla Recutita* (Matricaria) Flower Extract (and) Maltodextrin (and) Silica | 0.1 |
| Citric acid | 0.09 |
| Methylchloroisothiazolinone (and) Methylisothiazolinone | 0.0014 |

1Citric acid is present for pH adjustment in the commercially available (from Cognis Deutschland GmbH) emulsifier combination Eumulgin ® VL 75 (based on PGPH, Lauryl-glucoside, glycerol and water) which was used for preparing the lotion.

Conductivity measurements showed that the above lotion is of O/W type.

This lotion composition was heated to about 35° C. and applied with a rotogravure device on one side of two 2-ply webs in an amount of 3.5 g/m$^2$ each. Then the untreated side of one 2-ply web was partially coated with adhesive (cold glue or hotmelt) and then joined together in face to face relationship with the untreated side of the other 2-ply web, thereby obtaining a 4 ply web having lotion on both outer sides (total amount of lotion 7 g/m$^2$). The corresponding, but untreated 4-ply web showed a basis weight of about 65 g/m$^2$ and a thickness of about 505 μm, and a bulk of about 7.8 cm$^3$/g. This leads to an amount of about 11% by weight lotion based on the weight of the four-ply tissue.

The sinking behavior in water (water absorption time) of this lotioned tissue paper was determined in accordance with the DIN ENV 12625-8 as described above. The water absorption time was about 6 sec.

The viscosity/temperature dependence of this lotion as shown in FIG. 1 displayed a favourable, relatively broad plateau from 32° C. to 36° C. It was measured with a Haake Rheostress RS1 rheometer under the conditions indicated before. Accordingly, this lotion can be easily applied on tissue web at relatively low temperatures.

Comparative Example

The above lotion was compared with the lotion of WO 02/057547 A2 in respect of their whiteness (according to Din EN 12625-7, item 7.3.2, color (D65/10°) and smell.

As a reference point for the whiteness analysis, the whiteness of unlotioned tissue paper was taken as 100%. It turned out that the lotioned toilet paper of the present invention surprisingly shows a degree of whiteness (brightness) that is improved by about 4% (80.4 and 80.3 versus 76.7 as measured for the lotioned toilet paper of WO 02/057547). The corresponding values were measured with a Minolta spectrophotometer CM-3610d.

Moreover, two toilet papers were treated with the same amount of the lotion shown in the example of WO 02/057547 A2 and the lotion of the present invention, respectively, both however without perfume. The lotioned toilet papers were stored over 12 weeks at a temperature of 40° C. to accelerate aging. After 4, 8 and 12 weeks the toilet papers were presented to a test panel, which noticed after 8 weeks an off-odour (rancid odour) for the toilet paper made in line with WO 02/057547 A2. In contrast thereto, the toilet paper of the present invention did not develop any unpleasant odours.

In a second test, both toilet papers were treated with the respective perfume-containing lotions. The perfume had evaporated after 4 weeks. Again however, the test panel noticed after 8 weeks an off-odour (rancid odour) for the toilet paper made in line with WO 02/057547 A2, whereas the toilet paper of the present invention never developed any unpleasant odours.

The invention claimed is:

1. Toilet paper comprising tissue paper and a lotion, said tissue paper being treated with the lotion formed from an O/W emulsion comprising:

at least one non-ionic emulsifier;

at least one anionic co-emulsifier;

one oil component having a surface tension of at least 20 mN/m or a mixture of oil components wherein at least 75 weight-% of the oils constituting the mixture have a surface tension of at least 20 mN/m; and 6 to 35 weight % of water, based on a total weight of the emulsion, wherein a total amount of non-ionic emulsifier(s) and anionic co-emulsifier(s) is between 4 and 20 weight-%, based on the total weight of the emulsion, and a viscosity/temperature dependence exhibiting a broad plateau from 32° C. to 36° C., measured with a Haake Rheostress RS1 rheometer.

2. The toilet paper according to claim 1, wherein the emulsion comprises (a) at least one non-ionic emulsifier having an HLB value of less than 10;

(b) at least one further non-ionic emulsifier having an HLB value of more than 10;

(c) at least one anionic co-emulsifier;

(d) one oil component having a surface tension of at least 20 mN/m or a mixture of oil components wherein at least 75 weight-% of the oils constituting the mixture have a surface tension of at least 20 mN/m;

(e) 6 to 35 weight % of water, based on the total weight of the emulsion, (f) optionally at least one consistency regulator; and (g) optionally at least one humectant.

3. The toilet paper according to claim 2, wherein a weight ratio of non-ionic emulsifier (a) to further non-ionic emulsifier (b) is in a range of 1:0.5 to 1:2.

4. The toilet paper according to claim 2, wherein the anionic emulsifier (c) is present in an amount of 1 to 20 weight-% based on an amount of the further non-ionic emulsifier (b).

5. The toilet paper according to claim 1, wherein the emulsion comprises (a) at least one polyol polyester wherein a polyhydric alcohol having at least two hydroxy groups is esterified with at least one acid having from 6 to 30 carbon atoms and at least one hydroxy group, or condensation product(s) of this hydroxy fatty acid.

6. The toilet paper according to claim 1, wherein the emulsion comprises (a) polyol poly-12-polyhydroxystearate.

7. The toilet paper according to claim 1, wherein the emulsion comprises a further (b) non-ionic emulsifier selected from (b-1) products of the addition of 2 to 50 mol ethylene oxide and/or 0 to 20 mol propylene oxide onto linear fatty alcohols containing 8 to 40 carbon atoms, onto fatty acids contains 12 to 40 carbon atoms and onto alkylphenols containing 8 to 15 carbon atoms in the alkyl group;

(b-2) $C_{12/18}$ fatty acid monoesters and diesters of addition products of 1 to 50 mol ethylene oxide onto glycerol;

(b-3) glycerol mono- and diesters and sorbitan mono- and diesters of saturated and unsaturated fatty acids containing 6 to 22 carbon atoms and ethylene oxide addition products thereof;

(b-4) alkyl mono-, oligo and/or polyglycosides, or alkyl mono- and oligo and their alkoxylated or ethoxylated derivates;

(b-5) partial esters based on linear, branched, unsaturated or saturated C6-22 fatty acids, ricinoleic acid and 12-hydroxystearic acid and glycerol, polyglycerol, pentaerythritol, dipentaerythritol, sugar alcohols, alkyl glucosides and polyglucosides; or (b-6) polysiloxane/polyalkyl/polyether copolymers and corresponding derivatives;

and mixtures thereof.

8. The toilet paper according to claim 7, wherein the non-ionic coemulsifier (B) is selected from (b-4) alkyl mono-, oligo- and/or polyglycosides and their alkoxylated derivatives.

9. The toilet paper according to claim 1, wherein the anionic co-emulsifier (c) is selected from the group consisting of phosphate-, sulphate- and carboxylate emulsifiers.

10. The toilet paper according to claim 9, wherein the anionic co-emulsifier (c) is a carboxylate emulsifier.

11. The toilet paper according to claim 9, wherein the anionic co-emulsifier (c) is an acyl glutamate.

12. The toilet paper according to claim 1, wherein the anionic co-emulsifier (c) is present in an amount of 0.01 to 10 weight-%, based on the total weight of the emulsion.

13. The toilet paper according to claim 1, wherein the emulsion comprises a mixture of oils and at least 80 weight % of the oils constituting the mixture have a surface tension of at least 20 mN/m.

14. The toilet paper according to claim 13, wherein the emulsion comprises a mixture of (d-1) a hydrocarbon-based oil and (d-2) at least one oil selected from the group consisting of liquid synthetic triglyceride mixtures, vegetable oils, guerbet alcohols, liquid linear or branched carboxylic acid esters, liquid substituted cyclohexanes, symmetric or asymmetric dialk(en)ylethers having from 6 to 22 C atoms per alk(en)yl group, linear or branched dialk(en)ylcarbonates derived from 6 to 22 C atoms fatty alcohols, ring-opening products or epoxidized fatty acid esters and polyols, silicone oils and mixtures thereof.

15. The toilet paper according to claim 1, wherein the emulsion comprises one oil having a surface tension of at least 35 mN/m or a mixture of oils wherein at least 30 weight % of the oils constituting the mixture have a surface tension of at least 35 mN/m.

16. The toilet paper according to claim 1, wherein the emulsion comprises a hydrocarbon-based oil, as sole oil component or a mixture of (d-1) a hydrocarbon based oil and (d-2) at least one further oil.

17. The toilet paper according to claim 16, wherein the hydrocarbon-based oil (d-1) constitutes at least 40 weight-% of all oil components (d).

18. The toilet paper according to claim 1, wherein the emulsion comprises at least one oil selected from the group consisting of liquid synthetic triglyceride mixtures, vegetable oils, guerbet alcohols, liquid linear or branched carboxylic acid esters, liquid substituted cyclohexanes, symmetric or asymmetric dialk(en)ylethers having from 6 to 22 C atoms per alk(en)yl group, linear or branched dialk(en)ylcarbonates derived from 6 to 22 C atoms fatty alcohols, ring-opening products or epoxidized fatty acid esters and polyols, silicone oils and mixtures thereof.

19. The toilet paper according to claim 18, wherein the liquid carboxylic acid ester comprises either an acyl or an alkyl residue having each 1 to 5 carbon atoms.

20. The toilet paper according to claim 19, wherein the carboxylic acid ester has the following formula (I)

$$R^1COO—R^2 \quad (I)$$

wherein (i) $R^1CO$ represents an acyl residue having 6 to 28 carbon atoms, and $R^2$ represents an alkyl residue having 1 to 5 carbon atoms or (ii) $R^1CO$ represents an acyl residue having 1 to 5 carbon atoms, and $R^2$ represents an alkyl residue having 6 to 28 carbon atoms.

21. The toilet paper according to claim 1, wherein the oil or mixture of oils is present in an amount of 20 to 80 weight % based on the total weight of the emulsion.

22. The toilet paper according to claim 1, wherein the emulsion further contains at least one irritation-soothing agent.

23. The toilet paper according to claim 1, wherein the emulsion composition further comprises at least one consistency regulator (f) in an amount of 0.1 to 15 weight %.

24. The toilet paper according to claim 1, wherein the emulsion composition further comprises at least one humectant (g) in an amount of 0.5 to 15 weight %.

25. The toilet paper according to claim 1, wherein the emulsion has a viscosity of 100 to 10,000 mPa.times.s measured with a Brookfield RFV, spindle 3, 10 rpm.

26. The toilet paper according to claim 1, wherein the emulsion comprises:

(a) 2 to 15 weight % of a polyol polyester wherein a polyhydric alcohol having at least two hydroxy groups is esterified with at least one acid having from 6 to 30 carbon atoms and at least one hydroxy group or condensation product(s) of this hydroxy fatty acid;
(b) 2 to 15 weight % of at least one further non-ionic emulsifier;
(c) 0.01 to 10 weight-% of at least one anionic emulsifier;
(d) 40 to 70 weight % of an oil component having a surface tension of at least 20 mN/m or a mixture of oil components wherein at least 75 weight-% of the oils constituting the mixture have a surface tension of at least 20 mN/m;
(e) 12 to 32 weight % water;
(f) optionally 1 to 5 weight % of at least one consistency regulator;
(g) optionally 1 to 5 weight % humectant; and
(h) optionally 0.1 to 5 weight % additives or at least one irritation-soothing agent.

27. The toilet paper according to claim 26, wherein the emulsion comprises (d) a mixture of (d-1) at least one hydrocarbon-based oil and (d-2) at least one further oil selected from the group consisting of liquid synthetic triglyceride mixtures, vegetable oils, guerbet alcohols, liquid linear or branched carboxylic acid esters, liquid substituted cyclohexanes, symmetric or asymmetric dialk(en)ylethers having from 6 to 22 C atoms per alk(en)yl group, linear or branched dialk(en)ylcarbonates derived from 6 to 22 C atoms fatty alcohols, ring-opening products or epoxidized fatty acid esters and polyols, silicone oils and mixtures thereof.

28. The toilet paper according to claim 27, wherein the further oil (d-2) is a carboxylic acid ester represented by formula (I)

$$R^1COO—R^2 \quad (I)$$

wherein $R^1CO$ represents an acyl residue having 6 to 22 carbon atoms and $R^2$ represents an alkyl residue having 1 to 5 carbon atoms.

29. The toilet paper according to claim 1 being a multiply tissue paper.

30. The toilet paper according to claim 29, being a toilet paper having from 2 to 4 plies.

31. The toilet paper according to claim 1, wherein the emulsion is present in amount of 3 to 30 weight-%, based on the weight of the tissue paper.

32. Toilet paper comprising tissue paper and a lotion, said tissue paper being treated with the lotion formed from an O/W emulsion comprising:

at least one first non-ionic emulsifier;
at least one second non-ionic emulsifier having an HLB value of more than 10, a weight ratio of the first non-ionic emulsifier to the second non-ionic emulsifier being in a range of 1:0.5 to 1:2;
at least one anionic co-emulsifier;
one oil component having a surface tension of at least 20 mN/m or a mixture of oil components wherein at least 75 weight-% of the oils constituting the mixture have a surface tension of at least 20 mN/m; and
6 to 35 weight % of water, based on a total weight of the emulsion,
wherein a total amount of non-ionic emulsifier(s) and anionic co-emulsifier(s) is between 4 and 20 weight-%, based on the total weight of the emulsion, and
a viscosity/temperature dependence exhibiting a broad plateau from 32° C. to 38° C., measured with a Haake Rheostress RS1 rheometer.

33. A method for manufacturing toilet paper, comprising:

treating tissue paper with an O/W emulsion comprising:
at least one non-ionic emulsifier;
at least one anionic co-emulsifier;
one oil component having a surface tension of at least 20 mN/m or a mixture of oil components wherein at least 75 weight-% of the oils constituting the mixture have a surface tension of at least 20 mN/m; and
6 to 35 weight % of water, based on a total weight of the emulsion,
wherein a total amount of non-ionic emulsifier(s) and anionic co-emulsifier(s) is between 4 and 20 weight-%, based on the total weight of the emulsion, and
a viscosity/temperature dependence exhibiting a broad plateau from 32° C. to 36° C., measured with a Haake Rheostress RS1 rheometer.

* * * * *